US009647331B2

(12) United States Patent
Manry, Jr. et al.

(10) Patent No.: US 9,647,331 B2
(45) Date of Patent: May 9, 2017

(54) CONFIGURABLE ANTENNA ASSEMBLY

(71) Applicant: THE BOEING COMPANY, Chicago, IL (US)

(72) Inventors: Charles W. Manry, Jr., Auburn, WA (US); Eric J. Black, Bethell, WA (US)

(73) Assignee: The Boeing Company, Chicago, IL (US)

( * ) Notice: Subject to any disclaimer, the term of this patent is extended or adjusted under 35 U.S.C. 154(b) by 398 days.

(21) Appl. No.: 14/253,218

(22) Filed: Apr. 15, 2014

(65) Prior Publication Data

US 2015/0295309 A1 Oct. 15, 2015

(51) Int. Cl.
*H01Q 1/48* (2006.01)
*H01Q 3/24* (2006.01)
(Continued)

(52) U.S. Cl.
CPC ..... *H01Q 1/48* (2013.01); *H01Q 3/247* (2013.01); *H01Q 9/0442* (2013.01); *H01Q 15/0066* (2013.01)

(58) Field of Classification Search
CPC H01Q 1/48; H01Q 3/24; H01Q 3/245; H01Q 3/247; H01Q 3/26; H01Q 3/2658; H01Q 9/04; H01Q 9/0407; H01Q 9/0442; H01Q 15/0006; H01Q 15/006; H01Q 15/0066; H01Q 1/12; H01Q 1/22; H01Q 1/26; H01Q 1/27; H01Q 1/28; H01Q 1/288; H01Q 1/36; H01Q 1/364; H01Q 1/366; H01Q 1/38; H01Q 1/44; H01Q 3/01; H01Q 3/2605; H01Q 3/2611; H01Q 3/2629; H01Q 3/2676; H01Q 3/30; H01Q 3/34; H01Q 3/40; H01Q 3/44; H01Q 3/46; H01Q 9/0428; H01Q 9/0435; H01Q 23/00;
(Continued)

(56) References Cited

U.S. PATENT DOCUMENTS 5,982,326 A * 11/1999 Chow ..... H01Q 9/0435 342/365
6,275,188 B1 * 8/2001 Chen ..... H01Q 3/2629 342/14
(Continued)

FOREIGN PATENT DOCUMENTS

| | | |
|---|---|---|
| EP | 1465287 | 10/2004 |
| WO | WO 03/007427 | 1/2003 |
| WO | WO 2009/000815 | 12/2008 |

OTHER PUBLICATIONS

Extended European search report for Application No. 15153901.2-1811, dated Sep. 24, 2015.
(Continued)

*Primary Examiner* — Bernarr Gregory
(74) *Attorney, Agent, or Firm* — Joseph M. Butscher; The Small Patent Law Group, LLC

(57) ABSTRACT

An antenna assembly may include a first ground plane, a second ground plane that may be switched between grounding and non-grounding states, and first and second antenna layers. Each of the first and second antenna layers may include a plurality of pixels interconnected by a plurality of phase change material (PCM) switches. The PCM switches are configured to be selectively switched between phases to provide a plurality of antenna patterns within the first and second antenna layers.

19 Claims, 4 Drawing Sheets

(51) Int. Cl.
*H01Q 15/00* (2006.01)
*H01Q 9/04* (2006.01)
*H01Q 1/00* (2006.01)
*H01Q 3/00* (2006.01)

(58) Field of Classification Search
CPC ..... H01L 27/14; H01L 27/144; H01L 27/146; H01L 27/14643; H01L 27/14649; H01L 45/04; H01L 45/06; H01L 45/065; H04L 41/08; H04L 41/0803; H04L 41/0813; H04L 41/082; H05H 1/0006; H05H 1/0081
See application file for complete search history.

(56) References Cited

U.S. PATENT DOCUMENTS 6,295,026 B1 * 9/2001 Chen ..... H01Q 3/24 342/368
6,323,809 B1 11/2001 Maloney
6,333,712 B1 12/2001 Haugse
6,396,449 B1 5/2002 Osterhues
6,404,398 B1 * 6/2002 Chen ..... H01Q 1/288 342/368
6,512,487 B1 1/2003 Taylor
6,567,046 B2 * 5/2003 Taylor ..... H01Q 1/38 257/E29.336
6,828,556 B2 * 12/2004 Pobanz ..... H01L 27/14649 250/336.1
6,856,301 B2 * 2/2005 Walker ..... H01Q 1/366 343/700 MS
6,885,345 B2 * 4/2005 Jackson ..... H01Q 3/40 343/700 MS
7,046,209 B1 5/2006 McCarville
7,109,942 B2 9/2006 McCarville
7,109,943 B2 9/2006 McCarville
7,113,142 B2 9/2006 McCarville
7,151,499 B2 * 12/2006 Avakian ..... H01Q 23/00 343/700 MS
7,151,506 B2 * 12/2006 Knowles ..... H01Q 1/38 343/700 MS
7,420,524 B2 * 9/2008 Werner ..... H01Q 1/38 343/700 MS
7,474,273 B1 * 1/2009 Pavliscak ..... H01Q 1/366 343/754
7,561,109 B2 * 7/2009 Walton ..... H01Q 3/01 343/700 MS
7,561,115 B2 * 7/2009 Zeng ..... H04L 41/082 343/700 MS
7,566,889 B1 * 7/2009 Klein ..... H01Q 3/46 250/503.1
7,609,223 B2 * 10/2009 Manasson ..... H01Q 23/00 343/700 MS
7,626,134 B1 * 12/2009 Klein ..... H05H 1/0081 219/121.36
7,719,471 B1 * 5/2010 Pavliscak ..... H01Q 1/26 343/701
7,724,994 B1 * 5/2010 Pepper ..... H01Q 3/2676 342/375
7,965,249 B1 * 6/2011 Wolf ..... H01Q 9/0442 343/700 MS
7,999,747 B1 * 8/2011 Wedding ..... H01Q 1/366 343/701
8,213,757 B2 * 7/2012 Harrysson ..... H01Q 1/38 385/120
8,289,199 B2 * 10/2012 Baharav ..... H01Q 1/38 342/179
8,643,554 B1 2/2014 Manry
8,922,434 B2 * 12/2014 Prat ..... H01Q 1/44 343/700 MS
2003/0151555 A1 8/2003 Holshouser
2004/0201526 A1 10/2004 Knowles
2006/0097947 A1 5/2006 McCarville
2010/0177011 A1 7/2010 Sego

OTHER PUBLICATIONS

"A Low-Profile Broadband Phased Array Antenna," Munk, et al., IEEE (2003).
"Ultra-Wideband Arrays," Dover, et al., IEEE (2003).
"Electrical Behavior of Phase-Change Memory Cells Based on GeTe," Perniola, et al. IEEE Electron Device Letters, vol. 31, No. 5, (May 2010).
"On the Gain of a Reconfigurable-Aperture Antenna," Brown, IEEE Transactions on Antennas and Propagation, vol. 49, No. 10 (Oct. 2001).
"GTRI Reconfigurable Aperture Design," Pringle, et al., IEEE (2002).
"Non-Foster and connected planar arrays," Hansen, Radio Science, vol. 39, RS4004 (2004).
"A New Approach to Broadband Array Design Using Tightly Coupled Elements," Jones, et al., IEEE (2007).
"The Planar Ultrawideband Modular Antenna (PUMA) Array," Holland, IEEE Transactions on Antennas and Propagation, vol. 60, No. 1 (Jan. 2012).
"A Reconfigurable Aperture Antenna Based on Switched Links Between Electrically Small Metallic Patches," Pringle, et al., IEEE Transactions on Antennas and Propagation, vol. 52, No. 6 (Jun. 2004).
"Scan Blindness in Infinite Phased Arrays of Printed Dipoles," Pozar, IEEE Transactions on Antennas and Propagation, vol. AP-32, No. 6 (Jun. 1984).
"Vivaldi Antenna Arrays for Wide Bandwidth and Electronic Scanning," Schaubert, et al., IEEE (downloaded 2010).
"Simple Relations Derived from a Phased-Array Antenna Made of an Infinite Current Sheet," Wheeler, IEEE Transactions on Antennas and Propagation (Jul. 1965).
"A New Class of Antenna Array with a Reconfigurable Element Factor," Zhouyuan, et al., IEEE Transactions on Antennas and Propagation, vol. 61, No. 4 (Apr. 2013).

* cited by examiner

CONFIGURABLE ANTENNA ASSEMBLY

BACKGROUND OF THE DISCLOSURE

Embodiments of the present disclosure generally relate to antenna assemblies, and, more particularly, to configurable phased-array antenna assemblies that may be switched between a plurality of antenna personalities.

Microwave antennas may be used in various applications, such as satellite reception, remote sensing, military communication, and the like. Printed circuit antennas generally provide low-cost, light-weight, low-profile structures that are relatively easy to mass produce. These antennas may be designed in arrays and used for radio frequency systems, such as identification of friend/foe (IFF) systems, radar, electronic warfare systems, signals intelligence systems, line-of-sight communication systems, satellite communication systems, and the like.

One known antenna assembly provides a static antenna assembly that is incapable of scanning beyond 45° from normal to the antenna face while maintaining an ultrawide bandwidth ratio of 6:1 or more. Further, spiral antennas are typically too large for many practical applications and are incapable of providing polarization diversity. Another known antenna assembly provides a bandwidth ratio of 9:1 but generally exhibits an undesirably large voltage standing wave ratio (VSWR) when scanned beyond 50° from normal to the antenna face. Further, connected arrays over a ground plane have similar scan and VSWR limitations. Additionally, fragmented antenna arrays typically include small features that may not be scaled to high radio frequencies, may also be limited to small scan volumes, and may be inefficient.

In general, static designs they may be able to support one system function but typically cannot be used for multiple functions. Narrow band antennas are typically designed to support only one specific RF system and cannot be interchanged to support other system and frequencies out with great difficulty. Known static antenna wideband designs and assemblies typically do not provide a compact design having an instantaneous bandwidth of at least 6:1, wide field of view or scan capability up to 60° or more from normal to antenna face, and arbitrary current control that provides both selective bandwidth and polarization diversity capability.

SUMMARY OF THE DISCLOSURE

Certain embodiments of the present disclosure provide an antenna unit-cell phased array assembly that may include a first ground plane, a second ground plane that may be switched between grounding and non-grounding states, and an antenna array that may include first and second antenna layers. Each of the first and second antenna layers may include a plurality of pixels (or similar features) interconnected by a plurality of first phase change material (PCM) switches. The first PCM switches are configured to be selectively switched between phases to provide a plurality of antenna patterns within the first and second antenna layers. The first PCM switches are configured to be selectively switched to provide multiple antenna personalities.

The second ground plane may include a plurality of plates interconnected by a plurality of second PCM switches. The second PCM switches are selectively activated and deactivated to switch the second ground plane between the grounding and non-grounding states.

The antenna assembly may also include a plurality of control lines that connect the first ground plane to the second ground plane and the first and second antenna layers. For example, the first PCM switches may connect to the plurality of control lines.

The antenna assembly may also include a feed post mounted to the first ground plane. The second ground plane may secure to a portion of the feed post. The feed post may include one or more conductors that connect to the first and second antenna layers.

The antenna assembly may also include a first control grid connected to the first antenna layer, and a second control grid connected to the second antenna layer. Each of the first and second control grids may include a first set of traces that intersect with a second set of traces at a plurality of intersections that operatively connect to a respective one of the first PCM switches. Each of the intersections may be energized to switch each of the first PCM switches between phases. The first and second control grids may be configured to be frequency selective. Each of the first and second control grids may also include one or more inductors inserted at sub-wavelength intervals.

Each of the first PCM switches may be formed of Germanium Tellurium (GeTe) having first and second phases. One of the first and second phases is electrically conductive, and the other of the first and second phases is non-conductive.

Certain embodiments of the present disclosure provide an antenna assembly that may include an antenna array including at least one antenna layer. The antenna layer(s) may include a plurality of pixels interconnected by a plurality of first phase change material (PCM) switches. The first PCM switches are configured to be selectively switched between phases to provide a plurality of antenna patterns within the antenna array to provide multiple antenna personalities. In at least one embodiment, the at least one antenna layer includes at least two antenna layers. The antenna assembly may also include one or more switched ground planes that may be switched between grounding and non-grounding states.

DETAILED DESCRIPTION OF THE DISCLOSURE

The foregoing summary, as well as the following detailed description of certain embodiments will be better understood when read in conjunction with the appended drawings. As used herein, an element or step recited in the singular and proceeded with the word "a" or "an" should be understood as not excluding plural of the elements or steps, unless such exclusion is explicitly stated. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

Figure 1:
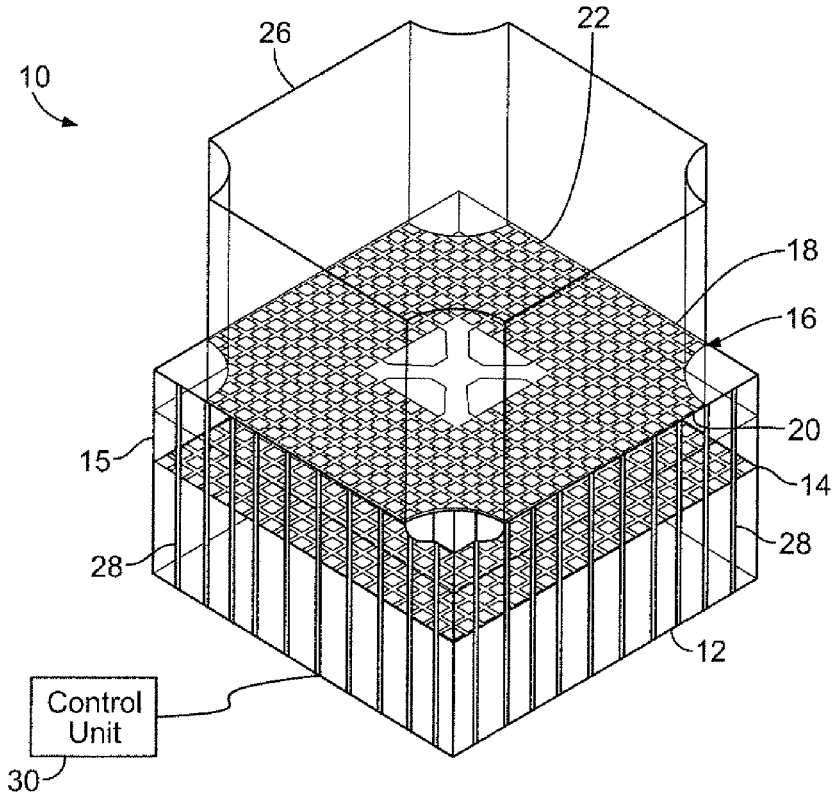
FIG. 1 illustrates a perspective top view of a configurable antenna assembly, according to an embodiment of the present disclosure.

FIG. 1 illustrates a perspective top view of a configurable antenna assembly 10, according to an embodiment of the present disclosure. The antenna assembly 10 may be a single or unit-cell in a multi-cell phased array. The antenna assembly 10 may include a first or base ground plane 12 that supports a feed post (partially hidden from view in FIG. 1). A second or switched ground plane 14 may be secured to and/or around the feed post above the ground plane 12. As shown, at least portions of the ground plane 12 and the switched ground plane 14 may be within a containment volume 15, which may be formed of a foam, dielectric material, and/or air.

An antenna array 16 is operatively connected to the feed post above the switched ground plane 14. The antenna array 16 may include first and second antenna layers 18 and 20 separated by a circuit board, for example. Alternatively, the antenna array 16 may include more than two antenna layers. Also, alternatively, the antenna array 16 may include only one antenna layer. Each antenna layer 18 and 20 may include a plurality of antenna pixels 22 connected to other antenna pixels 22 through switches, which may be formed of a phase change material, as described below.

A matching layer 26 may be positioned over the antenna array 16. The matching layer 26 is configured to match the antenna array 16 to free space or air. The matching layer 26 may be or include a radome, for example, which may be formed of a dielectric material. The radome provides a structural, weatherproof enclosure that protects the antenna array 16, and may be formed of material that minimally attenuates the electromagnetic signal transmitted or received by the antenna array 16. As shown, the matching layer 26 may be formed as a block, which may include drilled cylindrical or semi-cylindrical holes to form inwardly-curved corners that are configured to control undesired surface waves. However, the matching layer 26 may be various other shapes and sizes, such as a pyramid, sphere, or the like. Further, the matching layer may be formed from multiple materials. In at least one embodiment, the matching layer 26 may not include the inwardly-curved corners. The drilled holes may be formed using other shapes and sizes, such as rectangular, triangular, spherical, or the like. The drilled holes may be placed in different locations other than the corners and be formed by multiple holes and shapes. Alternatively, the antenna assembly 10 may not include the matching layer 26.

As shown, a plurality of control lines 28 extend upwardly from the ground plane 12, around the outer boundary of the switched ground plane 14, and around the outer boundary of the antenna array 16. The control lines 28 may form a lattice around the antenna assembly 10. The control lines 28 may be conductive metal traces that are configured to allow electrical signals to pass therethrough. The control lines 28 are configured to relay signals that switch the various switches within the antenna assembly between on and off positions (such as between conductive and non-conductive states of a phase change material switch) in order to switch the antenna assembly 10 between various antenna patterns.

Different antenna patterns may provide different antenna personalities. Each antenna personality may be defined as a unique combination of frequency, bandwidth, polarization, power level, scan angle, geometry, beam characteristics (width, scan rate, and the like), and the like.

The antenna assembly 10 may be operatively connected to a control unit 30. For example, the control unit 30 may be electrically connected to the control lines 28. The control unit 30 is configured to control switching between the plurality of antenna patterns, for example. The control unit 30 may be or otherwise include one or more computing devices, such as standard computer hardware (for example, processors, circuitry, memory, and the like). The control unit 30 may be operatively connected to the antenna assembly 10, such as through a cable or wireless connection. Optionally, the control unit 30 may be an integral component of the antenna assembly 10. Alternatively, the antenna assembly 10 may not include a separate and distinct control unit.

The control unit 30 may include any suitable computer-readable media used for data storage. For example, the control unit 30 may include computer-readable media. The computer-readable media are configured to store information that may be interpreted by the control unit 30. The information may be data or may take the form of computer-executable instructions, such as software applications, that cause a microprocessor or other such control unit within the control unit 30 to perform certain functions and/or computer-implemented methods. The computer-readable media may include computer storage media and communication media. The computer storage media may include volatile and non-volatile media, removable and non-removable media implemented in any method or technology for storage of information such as computer-readable instructions, data structures, program modules or other data. The computer storage media may include, but are not limited to, RAM, ROM, EPROM, EEPROM, flash memory or other solid state memory technology, CD-ROM, DVD, or other optical storage, magnetic cassettes, magnetic tape, magnetic disk storage or other magnetic storage devices, or any other medium which may be used to store desired information and that may be accessed by components of the control unit 30.

Figure 2:
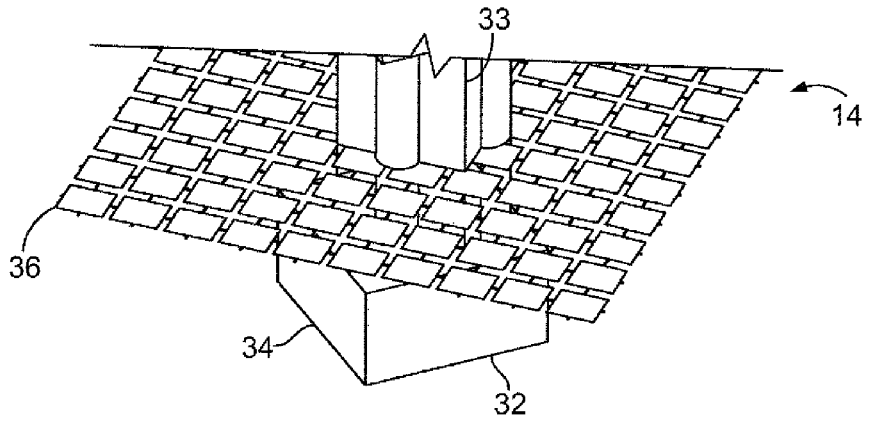
FIG. 2 illustrates a perspective partial top view of a switched ground plane connected to a feed post, according to an embodiment of the present disclosure.

FIG. 2 illustrates a perspective partial top view of the switched ground plane 14 connected to the feed post 32, according to an embodiment of the present disclosure. The feed post 32 includes a central column 33 that upwardly extends from a base 34, which may be supported over the ground plane 12 (shown in FIG. 1). A central aperture may be formed through the switched ground plane 14 so that the switched ground plane 14 may be secured around the central column 33 above the base 34. The switched ground plane 14 may include a plurality of interconnected metal plates 36.

Figure 3:
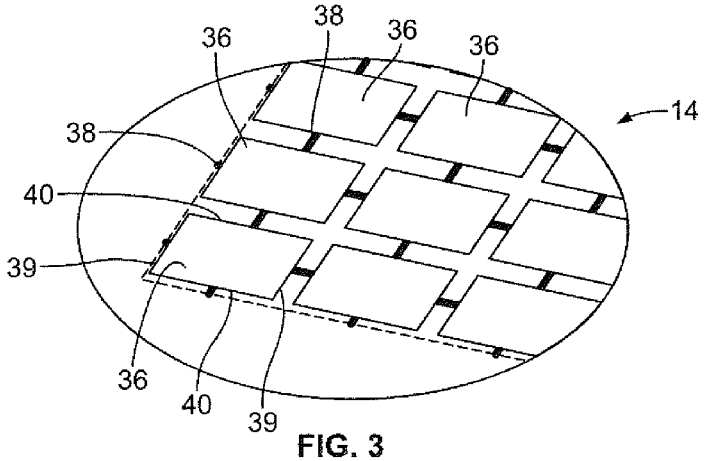
FIG. 3 illustrates a perspective top view of plates of a switched ground plane connected by switches, according to an embodiment of the present disclosure.

FIG. 3 illustrates a perspective top view of the plates 36 of the switched ground plane 14 connected by switches 38, according to an embodiment of the present disclosure. Each plate 36 may be formed in the shape of a rectangle having parallel ends 39 and parallel sides 40. Alternatively, the plates 36 may be formed as various other shapes and layouts.

As shown, the end 39 of each plate 36 is connected to an end 39 of a neighboring plate 36 by a switch 38. Similarly, the side 40 of each plate 36 is connected to a side 40 of a neighboring plate 36 by a switch 38. Further, switches 38 extend from outer ends 39 and outer sides 40 of the plates 36 at the periphery or outer unit-cell boundary of the switched ground plate 14. The switches 38 at the periphery of the switched ground plate 14 may connect to respective control lines 28 (shown in FIG. 1).

Each switch 38 may be formed of a phase change material (PCM), such as Germanium Tellurium (GeTe). A PCM melts and solidifies at distinct temperatures. Heat is absorbed or released when the PCM changes from solid to liquid, and vice versa. PCM switches do not require static bias for operation. Instead, power need only be applied during switching to switch the PCM switch between phases. One of the phases may be electrically conductive, while the other state may be non-conductive. In general, PCM switches have two stable states that differ in electrical conductivity by several orders of magnitude. Switching may be accomplished through controlled heating and cooling of the PCM switches.

Referring to FIGS. 1-3, the control lines 28 may be operated to switch the switches 38 on (such as to an active or conductive state), and off (such as to a deactivated or non-conductive state). When the switches 38 are off, the switched ground plane 14 may be in a non-grounding state. However, when the switches 38 are switched on, such as through signals relayed through the control line 28, the switched ground plane 14 may be switched to a grounding state that is above the ground plate 12. In short, by switching the switches 38 to the on position, a ground plane may be electrically moved or otherwise changed to the plane of the switched ground plane 14.

The switched ground plane 14 may be configured to tune the antenna assembly 10 to improve the high frequency behavior of the antenna assembly 10. The switched ground plane 14 may be switched on and off to selectively provide narrow and high band reception, for example. If all of the switches 38 are activated (for example, switched on, such as through phase change when power is applied during a switching operation), the switched ground plane 14 acts a solid sheet of metal. If, however, all of the switches 38 are deactivated, the switched ground plane 14 simply provides a grid of plates, so that it is in a non-grounding state and not significantly electrically present. Alternatively, the plates 36 may be created using non-metallic, resistive, or the like surface materials. Optionally, a portion of the switches 38 may be activated, while a remaining portion of the switches 38 may be deactivated.

Figure 4:
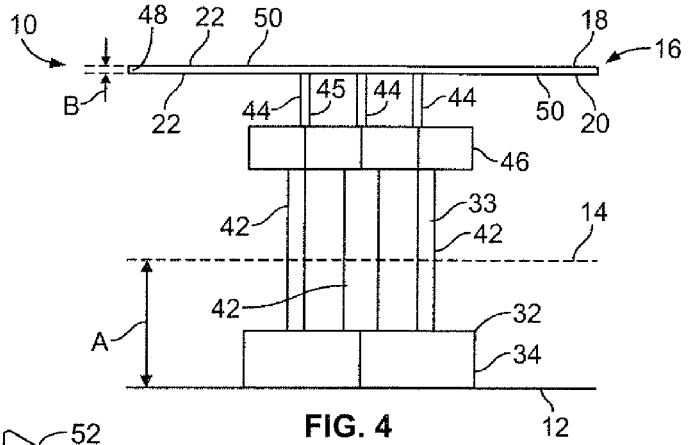
FIG. 4 illustrates a lateral view of an antenna assembly, according to an embodiment of the present disclosure.

FIG. 4 illustrates a lateral view of the antenna assembly 10, according to an embodiment of the present disclosure. For the sake of clarity, the control lines 28 are not shown in FIG. 4. The central column 33 of the feed post 32 contains a plurality of coaxial cables 42, which may include central conductors surrounded by a dielectric material, which, in turn, may be surrounded by a metal outer jacket that may form a coaxial transmission line. Upper ends 44 of the central conductors 45 extend upwardly from an upper collar 46 of the feed post 32. The central conductors 45 connect to the antenna array 16 to provide RF signaling thereto. For example, the central conductors 45 may provide the RF path from the coaxial cables 42 to the antenna array 16.

As shown, the switched ground plane 14 is separated from the ground plane 12 by a distance A. As such, when the switched ground plane 14 is activated, such as by the switches 38 changing phase, the effective ground plane to the antenna array 16 is moved up the distance A.

As noted above, the antenna array 16 may include an upper antenna layer 18 and a lower antenna array 20. The antenna layers 18 and 20 may be separated from one another by a circuit board 48 having a thickness B. As such, the antenna layers 18 and 20 are offset from one another by the distance B. The antenna pixels 22 of each antenna layer 18 and 20 may be interconnected by switches 50, such as PCM switches. Alternatively, the switches 50 may be other types of RF switches, such as MEMS, pin-diode, or the like.

Figure 5:
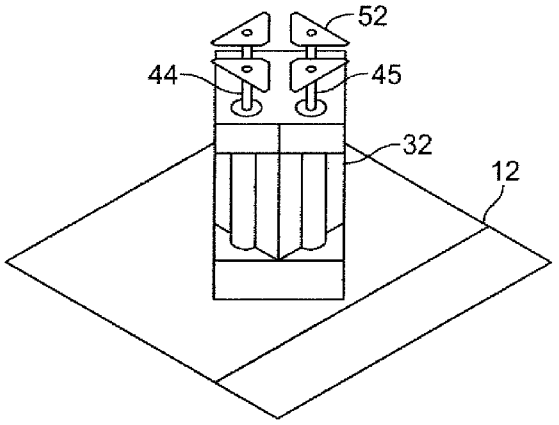
FIG. 5 illustrates a perspective top view of a feed post secured to a ground plane, according to an embodiment of the present disclosure.

FIG. 5 illustrates a perspective top view of the feed post 32 secured to the ground plane 12, according to an embodiment of the present disclosure. The upper end 44 of each conductor 45 may connect to a conductive transition member 52. The transition member 52 provides a transition from the conductors 45 to the antenna array 16 (not shown in FIG. 5). As shown, the transition members 52 may be formed as planar triangles. However, the transition members 52 may be various other shapes and sizes, such as rectangles, circles, and the like. Moreover, the transition members 52 may be or include one or more pixels, such as any of the pixels within the antenna layers 18 and 20 (shown in FIGS. 1 and 4).

Figure 6:
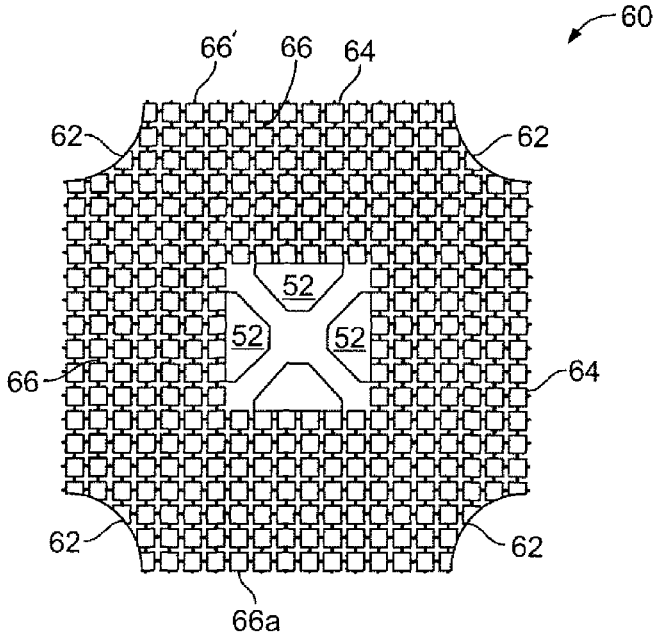
FIG. 6 illustrates a top plan view of an antenna layer, according to an embodiment of the present disclosure.

FIG. 6 illustrates a top plan view of an antenna layer 60, according to an embodiment of the present disclosure. Each of the antenna layers 18 and 20 shown in FIGS. 1 and 4 may be formed as the antenna layer 60. The antenna layer 60 is formed as a square with inwardly-curved corners 62 that may match the matching layer 26. However, the antenna layer 60 may be formed of various other shapes and sizes. For example, the antenna layer 60 may not include the inwardly-curved corners 62, nor match the features of the matching layer 26. Also, for example, the antenna layer 60 may be alternatively formed as a circle, triangle, trapezoid, and the like.

The antenna layer 60 includes a plurality of pixels 64 interconnected by switches 66, similar to the plates of the switched ground plane 14 described above. The pixels 64 may be similar in size, shape, and distribution. Alternatively, the pixels 64 may be non-uniform in size, shape, and/or distribution. The switches 66 may be formed of a PCM, such as GeTe. The switches 66' may be at the outer boundary of the antenna layer 60. The switches 66' may extend past the unit cell boundary of the antenna layer 60 to provide connectivity to an adjacent unit-cell antenna assembly. The switches 66, including the switches 66', may be selectively activated (for example, switched to a conductive state) and deactivated (for example, switched to a non-conductive state) through control and power signals received through the control lines 28 and/or the central conductors 45 by way of the transition members 52. The switches 66 may be activated or deactivated to form a desired antenna pattern of antenna pixels. For example, all of the switches 66 may be activated to form an antenna pattern of pixels in the shape of the antenna layer 60. Certain switches 66 may be deactivated to form an antenna pattern having a different shape.

Figure 7:
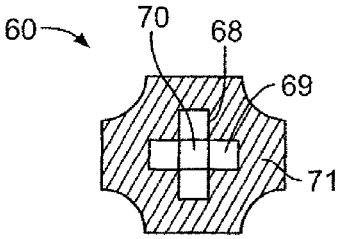
FIG. 7 illustrates a top plan view of an antenna pattern of an antenna layer, according to an embodiment of the present disclosure.

FIG. 7 illustrates a top plan view of an antenna pattern 68 of the antenna layer 60, according to an embodiment of the present disclosure. As shown, interior switches around a central aperture 70 may be activated to form active areas 69 of pixels, while outer switches may be deactivated to form deactivated areas 71 of pixels, resulting in a cross-shaped antenna pattern 68. One or both of the antenna layers 18 and 20 shown in FIGS. 1 and 4 may be operated to form the cross-shaped pattern 68.

Figure 8:
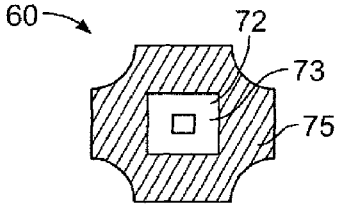
FIG. 8 illustrates a top plan view of an antenna pattern of an antenna layer, according to an embodiment of the present disclosure.

FIG. 8 illustrates a top plan view of an antenna pattern 72 of the antenna layer 60, according to an embodiment of the present disclosure. Internal switches may be activated forming active areas 73 of pixels, while outer switches are deactivated forming a deactivated area 75 of pixels, to form the square shaped antenna pattern 72. One or both of the antenna layers 18 and 20 shown in FIGS. 1 and 4 may be operated to form the square-shaped pattern 68.

Figure 9:
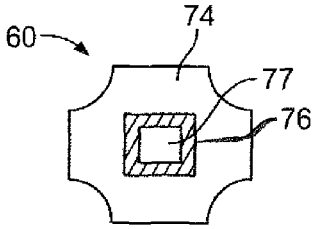
FIG. 9 illustrates a top plan view of an antenna pattern of an antenna layer, according to an embodiment of the present disclosure.

FIG. 9 illustrates a top plan view of an antenna pattern 74 of the antenna layer 60, according to an embodiment of the present disclosure. Intermediate switches may be activated, while internal and external switches are deactivated, to form the antenna pattern 74 defined by a deactivated square shaped center 77, and an active intermediate area 76 of pixels, which may be connected to the feed post through an active line of pixels (not shown in FIG. 9). One or both of the antenna layers 18 and 20 shown in FIGS. 1 and 4 may be operated to form the square-shaped pattern 68.

Referring to FIGS. 6-9, the switches 66 may be selectively activated and deactivated to form various antenna patterns. It is to be understood that the antenna patterns shown in FIGS. 7-9 are not necessarily optimal antenna configurations or patterns. Rather, FIGS. 7-9 are merely shown as examples of how various antenna patterns may be formed through embodiments of the present disclosure. Each antenna layer 18 and 20 shown in FIGS. 1 and 4 may have a separate and distinct antenna pattern, or the same antenna pattern. Again, the patterns shown in FIGS. 7-9 are merely examples. It is to be understood that various antenna patterns may be achieved through activating and deactivating certain switches 66 within the antenna layer 60. When the switches 66 are electrically activated, the activated switches 66 and pixels 64 connected thereto form various antenna patterns. In contrast, the deactivated switches 66 and pixels 64 connected thereto are generally not part of an operating antenna. In short, the deactivated switches 66 and pixels 64 connected thereto are not electrically present. Each switch 66 may be selectively activated and deactivated to provide a configurable, dynamic antenna pattern. The active antenna pattern or shape may be defined by which particular switches 66 are activated at any given time.

Referring to FIGS. 1 and 6-9, through the use of two antenna layers 18 and 20, overlapping regions of the two antenna layers may form parallel plate capacitors. At certain frequencies, the ground plane 12 may act as an inductor. Inductance is countered with capacitance. The capacitance of the antenna assembly 10 may be increased by the overlapping antenna layers 18 and 20, thereby reducing the inductance. As noted, the antenna assembly 10 may optionally include more than two antenna layers.

Figure 10:
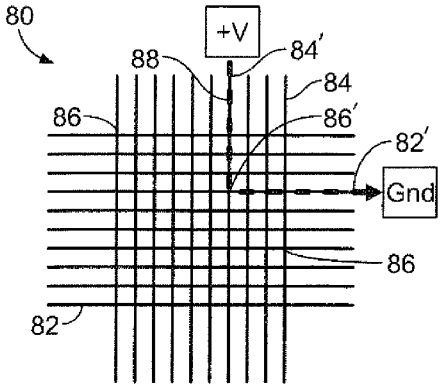
FIG. 10 illustrates a top plan view of a control grid, according to an embodiment of the present disclosure.

FIG. 10 illustrates a top plan view of a control grid 80, according to an embodiment of the present disclosure. A control grid, such as the control grid 80, may be positioned under each antenna layer 18 and 20, shown in FIGS. 1 and 2. Alternatively, the control grid 80 may be positioned over or within each antenna layer 18 and 20. The control grid 80 may be electrically coupled to the control lines 28, shown in FIG. 1, and/or to the conductors 45, shown in FIG. 4.

The control grid 80 includes a first set of parallel traces 82 and a second set of parallel traces 84 that are perpendicular to the first set of parallel traces 82. The parallel traces 82 intersect the parallel traces 84 at intersections 86. Each intersection 86 may abut into, or be otherwise proximate to, a switch within an antenna layer. For example, each switch may be associated with a respective intersection 86. The number and spacing of the traces 82 and 84 may correspond to the number of switches within a particular antenna layer, so that each switch may be associated with a distinct intersection 86.

As shown in FIG. 10, if voltage is applied to a trace 84', while the trace 82' is grounded, the intersection 86' is energized. As such, the particular switch associated with the intersection 86' is switched to an activated or deactivated state. The individual traces 82 and 84 may be selectively energized and grounded in such a manner to selectively activate and deactivate particular switches. For example, when the intersection 86' is activated, a PCM switch proximate to the intersection 86' undergoes a state change. Current flows from the trace 84' to the intersection 86' and to ground through the trace 82' over the path 88. In this manner, each switch does not need to be connected to a separate and distinct control line, thereby reducing the control line density within the antenna assembly 10. Further, once the particular switch is switched through the intersection being energized, the switch may remain in that particular state without further energy being supplied to the intersection.

The control grid 80 may provide control signals using frequency selective control lines. A frequency selective control line may be formed by inserting inductors at sub-wavelength intervals therein. The inductors may be sized to have low impedance at switch control frequencies (such as around 20 MHz), and high impedance at operational frequencies (such as between 2-12 GHz). At low frequencies, the control path, such as the path 88, provides a continuous conductive trace. At high frequencies, the path provides a broken set of sub-wavelength floating metal patches, which are invisible to a high frequency, radiating wave. In this manner, the path may be activated at low frequencies and disconnected at high frequencies so as not to interfere with operation of the antenna assembly.

As noted above, the switches may be PCM switches. As such, the control grid 80 may operate to supply power to the intersections 86 to address particular switches to switch them on or off. The PCM switches do not require static bias for operation. PCM switches have two stable states that differ in electrical conductivity by several orders of magnitude. Switching may be accomplished through controlled heating and cooling of the PCM switches. The switch associated with the intersection 86' is the addressed element that undergoes a state change. The switches may be sequentially changed to different states to form an antenna pattern.

A control grid, such as the control grid 80, may also be positioned underneath, above, or within the switched ground plane 14 (shown in FIGS. 1-3). As such, the intersections 86 may be associated with the switches 38 in order to change the switches 38 between on and off states.

Figure 11:
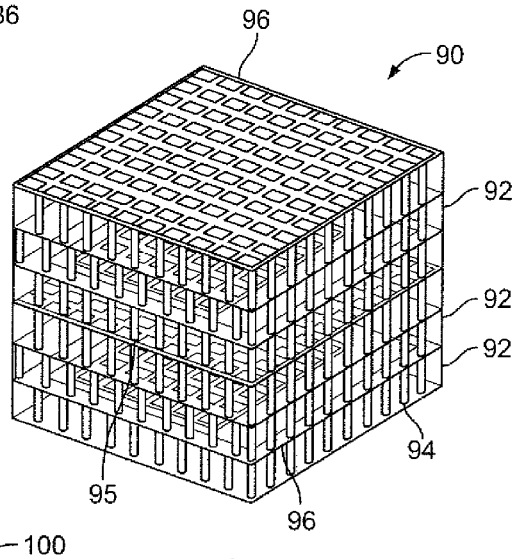
FIG. 11 illustrates a perspective top view of an antenna assembly, according to an embodiment of the present disclosure.

FIG. 11 illustrates a perspective top view of an antenna assembly 90, according to an embodiment of the present disclosure. The antenna assembly 90 may include the components described above. The antenna assembly 90 may include a plurality of modular outer dielectric or foam frames 92 having control line segments 94. Each modular outer frame 92 may be connected to another modular outer frame 92 to form a unit-cell outer boundary of the antenna assembly 90. A switched ground plane 95 may be supported by a feed post 96 and a modular outer frame 92.

As shown, an antenna array 96 may not include a central void or aperture. Any of the antenna layers described above may include central pixels without a central void formed therethrough or therebetween.

Figure 12:
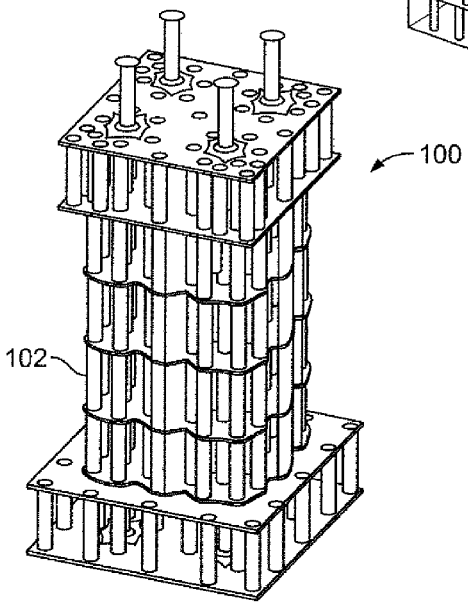
FIG. 12 illustrates a perspective top view of a feed post, according to an embodiment of the present disclosure.

FIG. 12 illustrates a perspective top view of a feed post 100, according to an embodiment of the present disclosure. In this embodiment, the feed post 100 is formed using printed circuit board manufacturing techniques. The feed post 100 may include a plurality of vias 102 that may be positioned through circuit boards (not shown). Accordingly, an antenna assembly may be formed with a plurality of circuit boards that communicate with one another through the vias 102.

Referring to FIGS. 1-12, embodiments of the present disclosure provide a configurable antenna assembly that may be adapted for wide bandwidth communication, such as of at least a 4:1 ratio. Embodiments of the present disclosure provide a configurable, adaptable antenna assembly that may be selectively switched between multiple antenna patterns and personalities. Embodiments of the present disclosure may scan at angles of 45° from normal to the face of the antenna, for example, and provide dual and separable RF polarization capability.

The antenna assembly may be reconfigured to provide RF performance personalities at narrow bandwidths (for example, 100 MHz), with the ability to scan at angles such as 45°, 60°, and the like. It has been found that the reconfigurable nature of the antenna assembly allows for operation at ultrawide bandwidth (for example, a 6:1 bandwidth ratio), or adjacent smaller band tunes as narrow as 100 MHz. The antenna assembly may be reconfigured to provide multiple personalities between first antenna pattern(s) configured for wideband operation, and second antenna pattern(s) configured for narrowband operation.

As described above, the antenna assembly may include two antenna layers, such as the antenna layers 18 and 20, which may be used to form, for example, a connected dipole array with capacitive dipole-like feeds underneath the connected antenna layers. The connected pixel and feed layers may be created using dual layer circuit boards, for example. The circuit board may be placed over a ground plane with foam dielectric layers below and above. A differential feed from the lower dipole-like feed may be capacitively coupled to a connected dipole element layer.

Each antenna layer may include a plurality of pixels. The pixels allow for multiple personalities by creating antenna patterns of varying shapes and sizes that may be used to tune the antenna assembly to specific frequencies, polarizations, and scan angles. The pixels may be interconnected using RF-compliant switches, which may be formed of phase change materials. The command and control of the switches may be achieved through use of addressed line schemes, such as those used in high density phase change memory systems.

It has been found that embodiments of the present disclosure provide antenna assemblies that may allow for wideband instantaneous bandwidth. The antenna assemblies may be switched to a narrow fractional bandwidth (such as 100 MHz) to provide better RF performance than is possible at a wideband tuning.

Embodiments of the present disclosure provide antenna assemblies in which on/off states of the connections, such as the switches, between the pixels, may be selectively activated and deactivated to provide a wide variety of antenna patterns. The different antenna patterns may be used for a variety of reasons, such as different missions, operational scenarios, and scan or field of view capabilities that are generally not possible with static array assemblies.

Embodiments of the present disclosure may be used with a multifunction and/or shared antenna configuration for communications, electronic warfare, RADAR and SIGNIT applications, for example. Embodiments of the present disclosure provide wide bandwidth coverage and polarization diversity to allow the transmission and reception of signals with any polarization that includes, but is not limited to, linear, circular, and slant polarized signals.

Certain embodiments of the present disclosure provide antenna assemblies that may include PCM switches, frequency selective control lines, and pixelated antenna layers. The antenna assemblies may be selectively configured between a plurality of antenna patterns.

Embodiments of the present disclosure provide antenna assemblies that may exhibit multiple antenna personalities. Each antenna personality may be a unique combination of frequency, bandwidth, polarization, power level, scan angle, geometry, beam characteristics (width, scan rate, and the like), and the like.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. An antenna assembly, comprising:

a first ground plane;

a second ground plane that is configured to be switched between grounding and non-grounding states; and first and second antenna layers, wherein each of the first and second antenna layers includes a plurality of first phase change material (PCM) switches, and wherein the plurality of first PCM switches are configured to be selectively switched to provide a plurality of antenna patterns within the first and second antenna layers.

2. The antenna assembly of claim 1, wherein the plurality of first PCM switches are configured to be selectively switched to provide multiple antenna personalities.

3. The antenna assembly of claim 1, wherein the second ground plane includes a plurality of plates interconnected by a plurality of second PCM switches, and wherein the plurality of second PCM switches are selectively activated and deactivated to switch the second ground plane between the grounding and non-grounding states.

4. The antenna assembly of claim 1, further comprising a plurality of control lines that connect the first ground plane to the second ground plane and the first and second antenna layers.

5. The antenna assembly of claim 4, wherein the plurality of first PCM switches connect to the plurality of control lines.

6. The antenna assembly of claim 1, further comprising a feed post mounted to the first ground plane, wherein the second ground plane secures to a portion of the feed post.

7. The antenna assembly of claim 6, wherein the feed post comprises one or more conductors that connect to the first and second antenna layers.

8. The antenna assembly of claim 1, further comprising:

a first control grid connected to the first antenna layer; and a second control grid connected to the second antenna layer, wherein each of the first and second control grids comprises a first set of traces that intersect with a second set of traces at a plurality of intersections that operatively connect to a respective one of the plurality of first PCM switches, and wherein each of the plurality of intersections is configured to be energized to switch each of the plurality of first PCM switches between phases.

9. The antenna assembly of claim 8, wherein the first and second control grids are configured to be frequency selective.

10. The antenna assembly of claim 8, wherein each of the first and second control grids further comprises one or more inductors inserted at sub-wavelength intervals.

11. The antenna assembly of claim 1, wherein each of the plurality of first PCM switches is formed of Germanium Tellurium (GeTe) having first and second phases, wherein one of the first and second phases is electrically conductive, and the other of the first and second phases is non-conductive.

12. An antenna assembly, comprising:

an antenna array including at least one antenna layer, wherein the at least one antenna layer includes a plurality of first phase change material (PCM) switches, and wherein the plurality of first PCM switches are configured to be selectively switched to provide a plurality of antenna patterns within the antenna array to provide multiple antenna personalities; and at least one control grid connected to the at least one antenna layer, wherein the control grid comprises a first set of traces that intersect with a second set of traces at a plurality of intersections that operatively connect to a respective one of the plurality of first PCM switches, and wherein each of the plurality of intersections is configured to be energized to switch each of the plurality of first PCM switches between phases.

13. The antenna assembly of claim 12, wherein the at least one antenna layer includes at least two antenna layers.

14. The antenna assembly of claim 12, further comprising a switched ground plane that is configured to be switched between grounding and non-grounding states.

15. The antenna assembly of claim 14, wherein the switched ground plane includes a plurality of plates interconnected by a plurality of second PCM switches, and wherein the plurality of second PCM switches are selectively activated and deactivated to switch the second plane between the grounding and non-grounding states.

16. The antenna assembly of claim 12, further comprising a plurality of control lines that connect to the antenna array.

17. The antenna assembly of claim 12, wherein the control grid is configured to be frequency selective, and further comprises one or more inductors inserted at sub-wavelength intervals.

18. The antenna assembly of claim 12, wherein each of the plurality of first PCM switches is formed of Germanium Tellurium (GeTe) having first and second phases, wherein one of the first and second phases is electrically conductive, and the other of the first and second phases is non-conductive.

19. An antenna unit-cell phased array assembly, comprising:

a first ground plane;

a second ground plane that is configured to be switched between grounding and non-grounding states, wherein the second ground plane includes a plurality of plates interconnected by a plurality of first phase change material (PCM) switches, and wherein the plurality of first PCM switches are selectively activated and deactivated to switch the second ground plane between the grounding and non-grounding states;

an antenna array comprising first and second antenna layers, wherein each of the first and second antenna layers includes a plurality of second PCM switches, and wherein the plurality of second PCM switches are configured to be selectively switched between first and second phases to provide a plurality of antenna patterns within the first and second antenna layers to provide multiple antenna personalities, wherein one of the first and second phases is electrically conductive, and the other of the first and second phases is non-conductive;

first and second control grids connected to the first and second antenna layers, respectively, wherein each of the first and second control grids comprises a first set of traces that intersect with a second set of traces at a plurality of intersections that operatively connect to a respective one of the plurality of second PCM switches, wherein each of the plurality of intersections is configured to be energized to switch each of the plurality of second PCM switches, wherein the first and second control grids are configured to be frequency selective, and wherein each of the first and second control grids further comprises one or more inductors inserted at sub-wavelength intervals;

a feed post mounted to the first ground plane, wherein the second ground plane secures to a portion of the feed post, wherein the feed post comprises one or more conductors that connect to the first and second antenna layers; and a plurality of control lines that connect the first ground plane to the second ground plane and the antenna array, wherein the plurality of first and PCM switches connect to the plurality of control lines.

* * * * *